US009390697B2

(12) United States Patent
Takegawa

(10) Patent No.: US 9,390,697 B2
(45) Date of Patent: Jul. 12, 2016

(54) REMOVABLE ELECTRONIC DRUM HEAD AND HOOP FOR ACOUSTIC DRUM

(71) Applicant: PEARL MUSICAL INSTRUMENT CO., Chiba (JP)

(72) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 0 days.

(21) Appl. No.: 14/576,457

(22) Filed: Dec. 19, 2014

(65) Prior Publication Data

US 2015/0179154 A1 Jun. 25, 2015

Related U.S. Application Data

(60) Provisional application No. 61/920,036, filed on Dec. 23, 2013.

(51) Int. Cl.
*G10H 1/32* (2006.01)
*G10D 13/02* (2006.01)

(52) U.S. Cl.
CPC ..... *G10H 1/32* (2013.01); *G10D 13/023* (2013.01); *G10D 13/024* (2013.01)

(58) Field of Classification Search
CPC ..... G10H 1/32
USPC ..... 84/730, 743
See application file for complete search history.

(56) References Cited

U.S. PATENT DOCUMENTS 3,956,959 A * 5/1976 Ebihara ..... G10D 13/08 84/725
5,430,245 A * 7/1995 Rogers ..... G10H 3/146 84/725
5,583,307 A 12/1996 Tobia, Jr.
6,753,467 B2 6/2004 Tanaka et al.
7,038,117 B2 5/2006 Yoshino
7,135,630 B2 11/2006 Maruhashi et al.
7,569,758 B2 8/2009 Harada et al.
7,612,273 B2 11/2009 Matsuyuki et al.
8,039,724 B1 10/2011 Norman et al.
8,173,886 B2 5/2012 Hashimoto
8,253,001 B1 * 8/2012 Liu ..... G10D 13/02 84/411 R
8,563,843 B1 10/2013 Shemesh
8,809,666 B1 * 8/2014 Liu ..... G10D 13/024 84/411 R
2003/0188629 A1 * 10/2003 Suenaga ..... G10H 3/146 84/723
2004/0083873 A1 * 5/2004 Yoshino ..... G10D 13/024 84/107
2005/0022655 A1 * 2/2005 Wise ..... G10H 3/146 84/743
2006/0021495 A1 * 2/2006 Freitas ..... G10H 3/12 84/723
2006/0219092 A1 * 10/2006 Mishima ..... G10H 1/0008 84/724
2007/0051231 A1 * 3/2007 Fujii ..... G10D 13/027 84/723
2009/0241755 A1 * 10/2009 Yoshino ..... G10D 13/024 84/421
2010/0105326 A1 * 4/2010 Hsien ..... G10H 3/146 455/41.2
2010/0282047 A1 * 11/2010 Hashimoto ..... G10H 1/32 84/723
2010/0313732 A1 * 12/2010 Yoshino ..... G10D 13/023 84/413
2011/0167992 A1 * 7/2011 Eventoff ..... G10H 1/0558 84/723

(Continued)

*Primary Examiner* — David Warren
(74) *Attorney, Agent, or Firm* — Manelli Selter PLLC; Edward J. Stemberger

(57) ABSTRACT

An electronic drum head is provided that attaches to a standard acoustic drum shell. The drum head is a self-contained unit that replaced both the acoustic drum head and the drum hoop or rim to convert the acoustic drum into an electronic drum. When the drummer plays these heads, the drum head is muted, minimizing acoustic noise from the kit. Also, these electronic drum heads can be easily attached and removed, allowing the drummer to go back to playing his acoustic drums when desired.

18 Claims, 6 Drawing Sheets

(56) References Cited

U.S. PATENT DOCUMENTS

2012/0097009 A1* 4/2012 Eventoff ..... G01D 13/024 84/413
2012/0180621 A1* 7/2012 Holl ..... G10D 13/027 84/723
2013/0098227 A1* 4/2013 Wei ..... G10D 13/02 84/723
2013/0112068 A1* 5/2013 Rogers ..... G10D 13/02 84/723
2013/0152765 A1* 6/2013 Morita ..... G10H 1/32 84/413
2013/0180388 A1 7/2013 Mori
2014/0216234 A1* 8/2014 Wei ..... G10D 13/024 84/723
2014/0305280 A1* 10/2014 Yoshino ..... G10D 13/02 84/411 A
2015/0082967 A1* 3/2015 Yoshino ..... G10D 13/022 84/411 M
2015/0179154 A1* 6/2015 Takegawa ..... G10D 13/024 84/723

* cited by examiner

REMOVABLE ELECTRONIC DRUM HEAD AND HOOP FOR ACOUSTIC DRUM

CROSS-REFERENCE TO RELATED APPLICATIONS AND CLAIM TO PRIORITY

This application is related to provisional application No. 61/920,036, filed Dec. 23, 2013 in the United States of America, the disclosure of which is incorporated herein by reference and to which priority is claimed.

BACKGROUND OF THE INVENTION

1. Field of the Invention

The present invention relates generally to electronic and acoustic drums and more specifically to an electronic drum head that can be attached to a conventional acoustic drum shell.

2. Background of the Related Art

Drummers face a number of problems with their chosen instrument because acoustic drum kits are generally large and take up substantial amounts of space, and can be very loud when played. Acoustic drums are also limited in the types of sounds they are capable of producing. Additionally, acoustic drums may be difficult to record when using a microphone.

FIG. 1 illustrates a conventional acoustic drum, which typically includes a cylindrical drum shell 2 having a mounting fixture 1 for attaching the acoustic drum to a boom (not shown) or other support device. A drum head 5 is secured to the shell 2 by a hoop or rim 3, and tuning devices 4 disposed equiangularly about shell 2 are used to adjust the tension on and thus the tuning of the drum head 5 by adjusting the tightness of the tuning lugs 4*a*.

Notably, the entire drum head 5 and the hoop/rim 3 may be removed from the drum shell 2 by completely removing the tuning lugs 4*a* from the tuning devices 4 or otherwise removing the hoop/rim 3 from the tuning lugs 4*a*. In that case, the hoop/rim 3 and the drum head 5 can be removed from the shell 2.

To provide a more versatile and modern drum, the electronic drum kit was invented to provide a variety of sound options and downloading capabilities. There are many examples of stand-alone electronic drum kits, including electronic drum kits made by Alesis, Simmons, Roland, and Yamaha. Electronic drum kits are easier to record and are capable of producing a wide range of musical effects, including certain effects not possible on a conventional acoustic drum kit. However, electronic drum kits are also large and require a substantial amount of space. Electronic drum kits are also electronic only and are not capable of producing conventional acoustic percussion music.

Most professional musicians and drummers prefer to have both an electronic drum kit and an acoustic kit, which effectively doubles the floor space required to store and use these instruments. Accordingly, there is a perceived need in the art for the capability to utilize both an acoustic drum kit and an electronic drum kit, which kit may be selected according to the drummer's needs.

SUMMARY OF THE INVENTION

The present invention solves the problems of the prior art by providing an electronic drum head with a stand-alone drum rim that attaches to a standard acoustic drum shell. It is self-contained unit that replaces both the acoustic drum head and the drum hoop or rim to convert the acoustic drum into an electronic drum. When the drummer plays with an electronic head mounted to the acoustic drum shell, the drum head is muted and acoustic noise from the kit is minimized. Also, the electronic drum head can be easily attached and removed, allowing the drummer to go back to playing an acoustic drum when desired. A separate electronic drum kit is not necessary, resulting in a substantial savings of space. Electronic drums give the drummer access to an almost unlimited array of sounds, not limited to traditional drum sounds. Finally, electronic drums do not require a microphone for recording. The sounds can be recorded directly from the line outputs of the electronic drum head module.

An objective of the present invention is to create an easily removable electronic drum head assembly that attaches to a traditional acoustic drum shell by replacing both the drum head and drum hoop while also providing the versatility of attaching the same drum head assembly to a stand-alone boom in a conventional manner.

BRIEF DESCRIPTION OF THE DRAWINGS

These and other features, aspects, and advantages of the present invention will become better understood with reference to the following description, appended claims, and accompanying drawings where:

DETAILED DESCRIPTION OF THE PREFERRED EMBODIMENT

Figure 2:
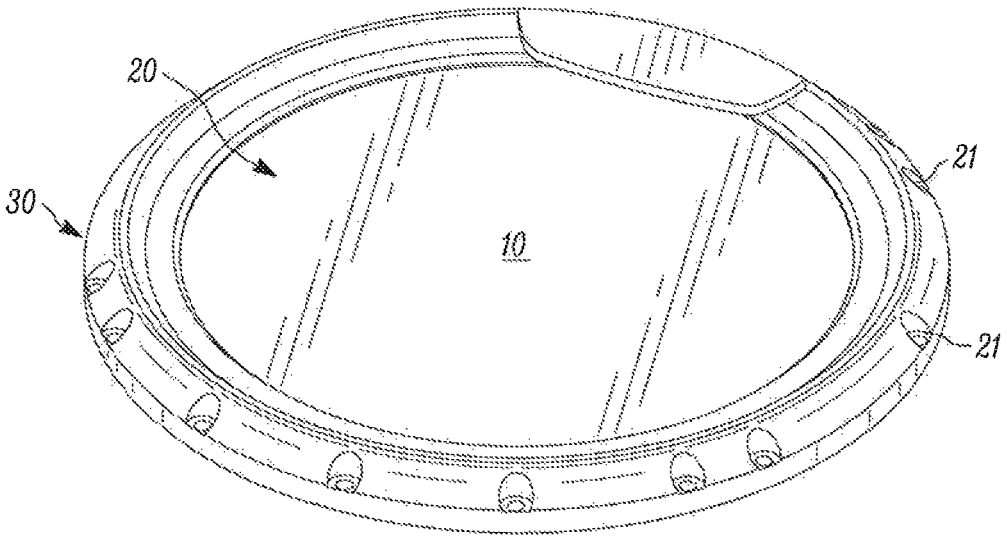
FIG. 2 is a perspective view of the invention from the top side.

With reference to FIG. 2, the present invention comprises an integrated electronic drum pad 10 that includes an electronic head 20 and an integrated hoop 30 that form an integrated unit that may be mounted directly to an acoustic drum shell as a stand-alone unit. Thus, a drummer may simply remove an acoustic drum head and rim assembly and replace them with the integrated electronic drum head and rim assembly of this invention. Drum pad 10 has a plurality of openings 21 formed about hoop 30.

Figure 3:
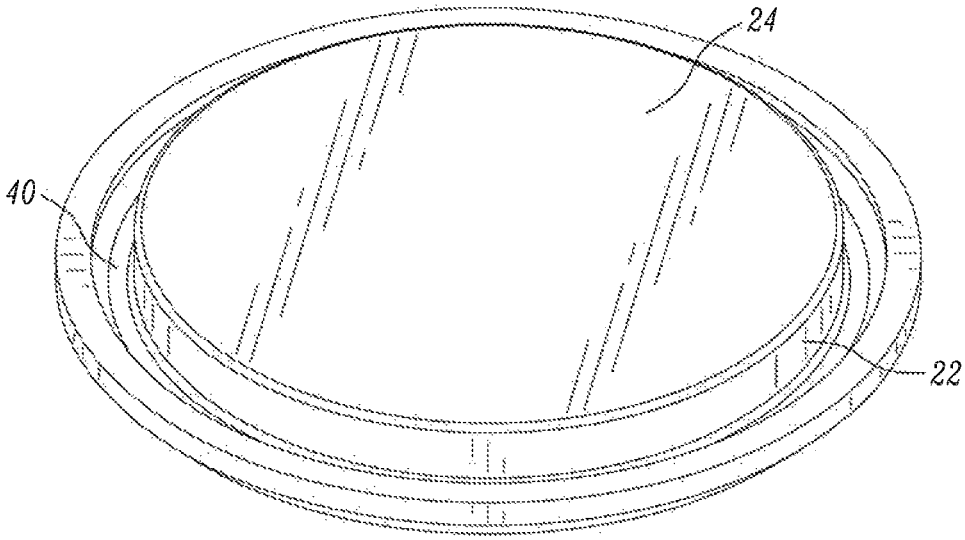
FIG. 3 is a perspective view of the present invention from the bottom side.

With reference to FIG. 3, the underside of the integrated drum pad and hoop is formed with a channel 40 that receives the top edge of the standard drum shell. The hoop 30 is not a standard acoustic drum hoop. The drum hoop 30 is designed to be integrated with an electronic drum head as a unitary assembly. Elastomeric ring 22 is attached to hoop 30 and extends about electronic container 24 disposed inwardly of hoop 30. Ring 22 may be seated in a groove (not shown) formed in container 24 or attached by adhesive or the like. Ring 22 may be manufactured from a suitable polymer such as any of a number of rubber materials or the like.

Figure 1:
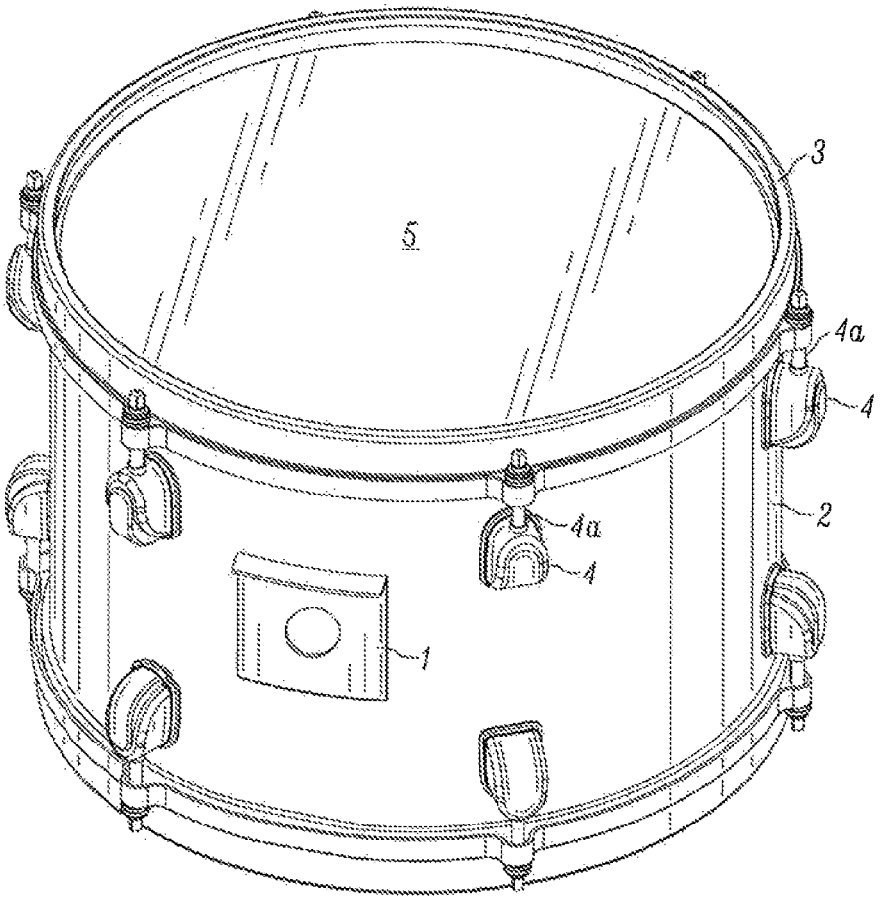
PRIOR ART FIG. 1
FIG. 1 is a perspective view illustrating a conventional acoustic drum.
Figure 4:
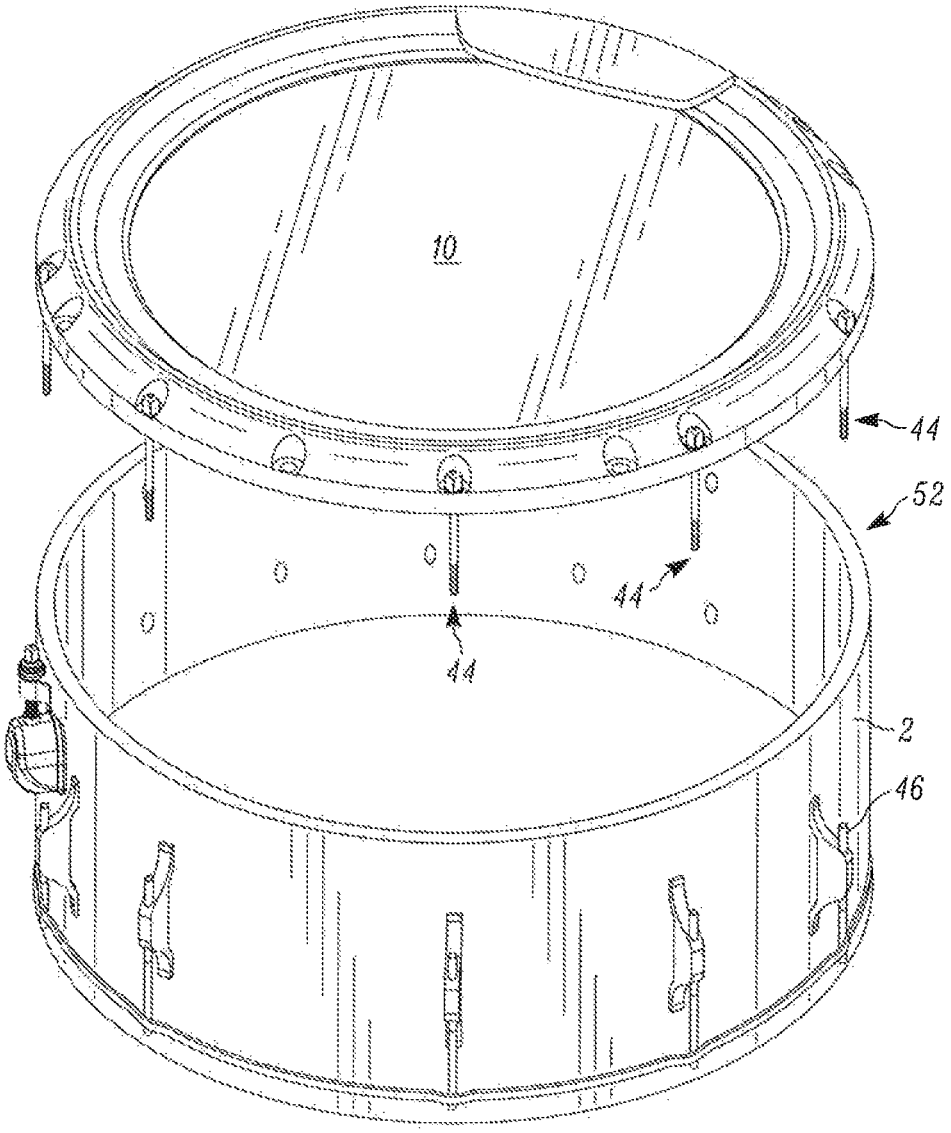
FIG. 4 is an assembly view of the present invention being mounted to an acoustic drum shell.

With reference to FIG. 4, the integrated drum pad 10 is mounted to a standard drum shell by first removing the acoustic head 5 and hoop 3 (as described above with reference to FIG. 1) from acoustic shell 2. Drum pad 10 may then be mounted to the top edge 52 of the acoustic drum shell 2. As shown in FIG. 4, the standard tension rods 44 are provided and the tuning devices 46 aligned with the openings 21. The top edge 52 preferably is tapered, as best shown in FIG. 4, or have other appropriate shape. The ring 22 seats with top edge 52 and minimizes extraneous sound after drum pad 10 is secured to shell 2 through lugs 44 and tuning devices 46.

Figure 5:
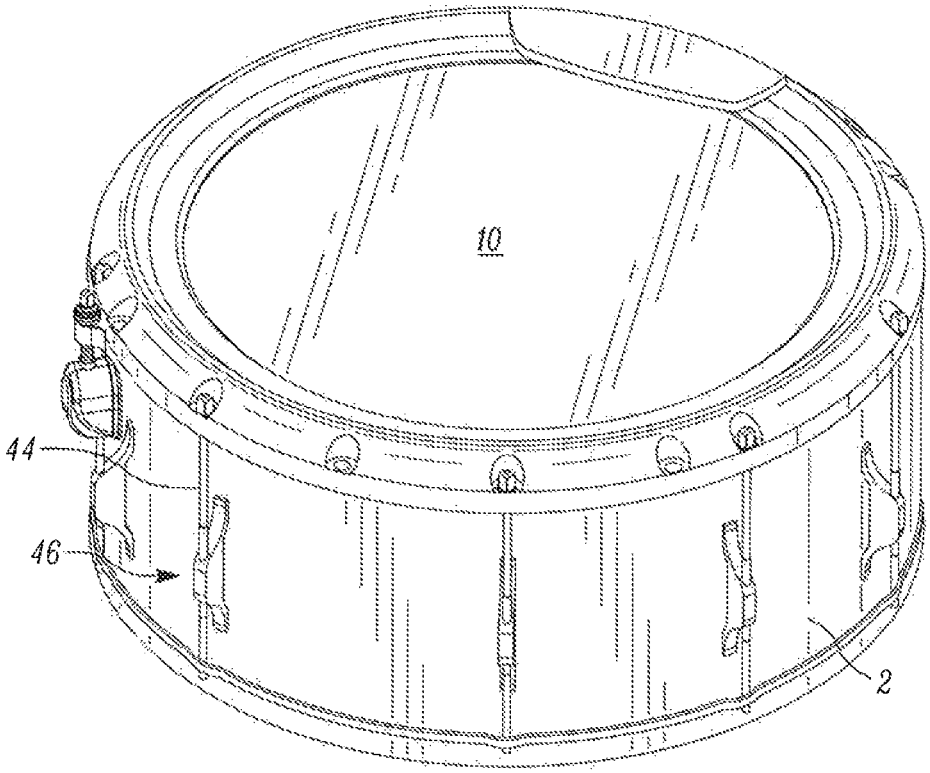
FIG. 5 is a perspective view of the present invention after being mounted to an acoustic drum shell.

With reference to FIG. 5, the integrated drum pad 10 is shown after being mounted to the acoustic drum shell 2 with the tension rods 44 appropriately fastened to the tuning devices 46. The drummer may selectively adjust the tension applied to lugs 44 in order to secure drum pad 10 to acoustic shell 2.

Figure 6:
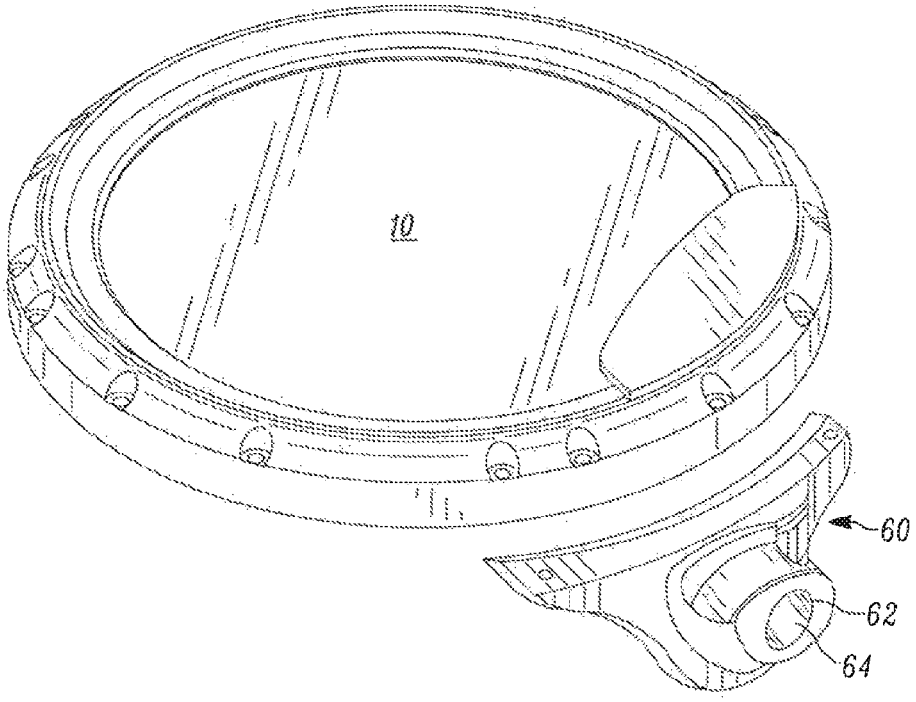
FIG. 6 is a perspective view of the present invention being prepared to be mounted via a mounting bracket to an adjacent boom or stand.

With reference to FIG. 6, another feature of the present invention is the ability to mount the drum pad 10 directly to a bracket 60 that is affixed to the integrated hoop 30 that may be supported by a standard boom (not shown). The rim 30 is sufficiently large in order to securely support bracket 60 in order to expose support arm 62. Support arm 60 preferably has an opening 64 to receive a support arm extending from the boom. The support arm 62 extends perpendicularly to the plane of pad 10, and protrudes outwardly from rim 30. A set screw (not shown) or the like may be used to secure support arm 62 to the boom. The drummer may those choose to use the drum pad 10 as a stand-alone drum or attach it to shell 2.

Figure 7:
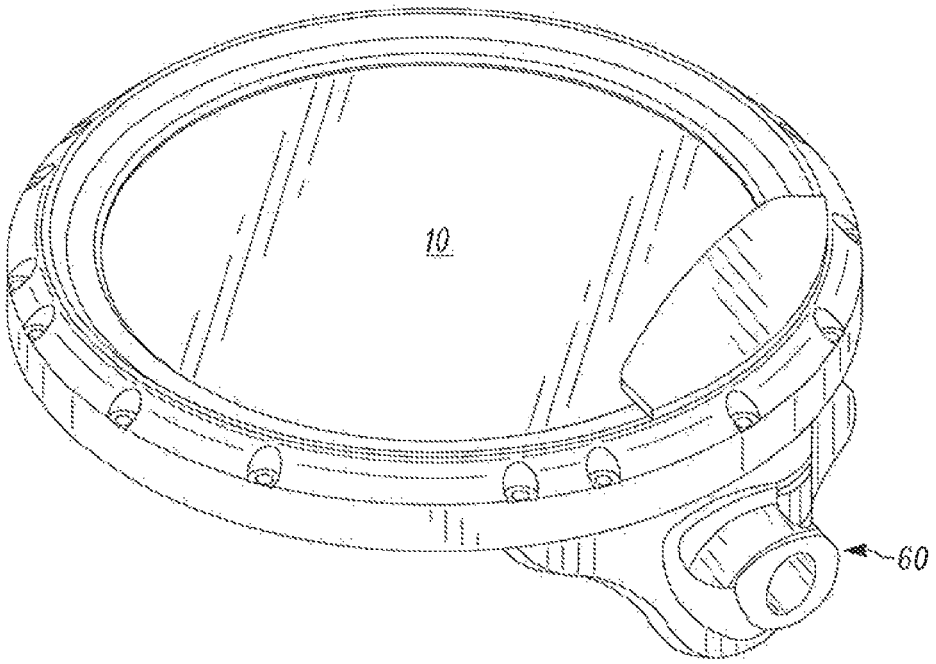
FIG. 7 is a perspective view of the present invention after being mounted to a mounting bracket.

With reference to FIG. 7, the integrated pad 10 is illustrated after being mounted to the bracket 60. Bolts or other mechanical fasteners may be used to secure bracket 60 to rim 30.

The specific arrangement of the electronics such as strike pads, piezo sensors, metal and non-metal plates, force sensing resistors, strike sensors and velocity sensors, wiring and other circuitry are shown for example in U.S. Pat. No. 8,039,724 which is incorporated herein by reference in its entirety. The electronic drum pad 10 includes within container 24 at least one of a piezo sensor, a force sensing resistor, a strike sensor and a velocity sensor electrically connected to circuitry for delivering electronic signals to a processor that processes the signals to replicate the acoustic sound of a drum.

While the foregoing invention has been shown and described with reference to a single embodiment, it will be understood by those of skill in the art the various changes in form and detail may be made therein without deporting from the spirit and scope of the instant invention.

The invention claimed is:

1. A drum system, comprising:

a stand-alone integrated electronic drum pad including an electronic drum head and an integrated hoop circumscribing said electronic drum head;

said electronic drum pad including at least one of a piezo sensor, a force sensing resistor, a strike sensor and a velocity sensor electrically connected to circuitry for delivering electronic signals to a processor; and said hoop including a plurality of apertures for receiving a corresponding plurality of tension rods fixed to a drum shell, wherein said drum pad includes an elastomeric ring disposed about said hoop for mating with the shell.

2. The drum system according to claim 1, further comprising a drum shell sized to mate with said integrated electronic drum pad.

3. The drum system according to claim 2, wherein an underside of said integrated electronic drum pad includes a channel sized to mate with a top edge of said drum shell.

4. The drum system according to claim 2, further comprising tension rods interconnecting said integrated electronic drum pad with said drum shell.

5. The drum system according to claim 1, wherein said electronic drum head and said integrated hoop are formed as a unitary assembly that fits onto a drum shell.

6. The drum system according to claim 1, further comprising a boom bracket for attaching said integrated electronic drum pad with a boom to support said integrated electronic drum pad.

7. The drum system according to claim 1, wherein a container protrudes from a surface of said pad, and said at least one of a piezo sensor, a force sensing resistor, a strike sensor and a velocity sensor electrically is positioned within said container.

8. The drum system according to claim 7, wherein said ring extends about said container.

9. A drum system, comprising:

a drum shell;

a stand-alone integrated electronic drum pad including an electronic drum head and an integrated hoop circumscribing said electronic drum head;

said electronic drum pad including at least one of a piezo sensor, a force sensing resistor, a strike sensor and a velocity sensor electrically connected to circuitry for delivering electronic signals to a processor;

said hoop including a plurality of apertures; and a plurality of tension rods fixed to the drum shell and extending through said apertures for securing said drum pad to said shell.

10. The drum system according to claim 9, wherein said drum pad includes an elastomeric ring disposed about said hoop for mating with the shell.

11. The drum system according to claim 10, wherein a container protrudes from a surface of said pad, and said at least one of a piezo sensor, a force sensing resistor, a strike sensor and a velocity sensor electrically is positioned within said container.

12. The drum system according to claim 11, wherein said ring extends about said container.

13. The drum system of claim 9, wherein said hoop has a portion protruding beyond said shell, and said apertures formed in said protruding portion.

14. The drum system of claim 9, wherein a bracket is secured to said hoop, said bracket protruding from said hoop and including an opening therein for receiving a boom.

15. The drum system of claim 14, wherein said bracket extends parallel to the plane of said drum pad.

16. The drum system of claim 10, wherein said shell has a tapered upper surface and said ring mates with said tapered surface.

17. The drum system of claim 11, wherein said ring is secured about said container.

18. The drum system of claim 17, wherein said container is generally cylindrical and has a diameter less than the diameter of said pad.

* * * * *